US009878894B1

(12) United States Patent
Anderson, Jr. et al.

(10) Patent No.: US 9,878,894 B1
(45) Date of Patent: Jan. 30, 2018

(54) FLUID DELIVERY DEVICES HAVING IMPROVED EFFICIENCY IN DELIVERING FLUID WITH REDUCED WASTAGE OF FLUID

(71) Applicant: FUNAI ELECTRIC CO., LTD., Osaka (JP)

(72) Inventors: James D. Anderson, Jr., Lexington, KY (US); Tim Frasure, Lexington, KY (US); Sean Weaver, Lexington, KY (US); David Bernard, Lexington, KY (US); David Graham, Lexington, KY (US); Andrew McNees, Lexington, KY (US)

(73) Assignee: Funai Electric Co., Ltd. (JP)

( * ) Notice: Subject to any disclaimer, the term of this patent is extended or adjusted under 35 U.S.C. 154(b) by 0 days.

(21) Appl. No.: 15/205,587

(22) Filed: Jul. 8, 2016

(51) Int. Cl.
*B67D 7/02* (2010.01)
*B41J 2/175* (2006.01)

(52) U.S. Cl.
CPC ..... *B67D 7/0216* (2013.01); *B41J 2/17503* (2013.01); *B41J 2/17513* (2013.01)

(58) Field of Classification Search
CPC ..... B41J 2/17513; B41J 2/17516; B41J 2/17503; B41J 2/175; B41J 2/17563; B41J 2002/17516; B41J 2/1752; B41J 2/17523; B41J 2/17509
See application file for complete search history.

(56) References Cited

U.S. PATENT DOCUMENTS

| | | | | |
|---|---|---|---|---|
| 6,170,939 | B1 * | 1/2001 | Ujita | B41J 2/17513 347/86 |
| 7,478,901 | B1 | 1/2009 | Myers et al. | |
| 2002/0071002 | A1 | 6/2002 | Kawamura et al. | |
| 2003/0001936 | A1 | 1/2003 | Hirosawa et al. | |
| 2007/0139493 | A1 | 6/2007 | Campbell et al. | |
| 2010/0238233 | A1 | 9/2010 | Baker et al. | |
| 2011/0175973 | A1 | 7/2011 | Tajima | |
| 2014/0063113 | A1 | 3/2014 | Irving et al. | |
| 2014/0184708 | A1 | 7/2014 | Hayashi et al. | |
| 2015/0343788 | A1 | 12/2015 | Anderson, Jr. et al. | |

* cited by examiner

*Primary Examiner* — Henok Legesse
(74) *Attorney, Agent, or Firm* — Luedeka Neely Group, PC

(57) ABSTRACT

A fluidic delivery device includes a fluid supply containing a fluid, the fluid supply has a fluid reservoir and a pair of fluid permeable compressible bodies located in the fluid reservoir. One of the fluid permeable compressible bodies has an effective greater density than the other fluid permeable compressible body.

8 Claims, 4 Drawing Sheets

FLUID DELIVERY DEVICES HAVING IMPROVED EFFICIENCY IN DELIVERING FLUID WITH REDUCED WASTAGE OF FLUID

FIELD

This disclosure relates generally to apparatus for delivering fluid. More particularly, this disclosure relates to fluidic delivery devices having improved efficiency in delivering fluid with reduced wastage of fluid.

BACKGROUND

Improvement is desired in the field of fluidic structures of the type used to dispense fluid from a storage supply. Inkjet printheads are one example of fluidic structures that operate by dispensing fluid from a fluid supply.

Conventional fluidic structures for dispensing fluid from a fluid supply desire improvement in their ability to more completely utilize the fluids they are designed to dispense and reduce wasting of fluid. For example, conventional devices typically cannot dispense more than about 80 percent of the stored fluid, leaving the undispensed fluid in the device once the device has exhausted its functional life.

This undispensed fluid represents a significant waste of fluid and also disadvantageously affects the size of construction of the device. For example, as desired fluid levels in such devices increase, the fluid volumetric efficiency of the device becomes of greater concern. An inefficient device requires a larger volume of fluid, which requires a larger device, which impacts the cost. Also, the increased mass of a larger device can also negatively affect the fragility during shipping and handling, as well as shipping costs for gross shipment of devices.

Accordingly, what is desired are fluidic devices that promote improved efficiency of dispensing fluid. Improved efficiency will result in more of the fluid stored in the device being dispensed. This will reduce the amount of fluid that is wasted and remains in the device once the device has completed its service life.

SUMMARY

The present disclosure relates to fluidic delivery devices. The device includes a fluid supply containing a fluid, the fluid supply has a fluid reservoir and a pair of fluid permeable compressible bodies located in the fluid reservoir. One of the fluid permeable compressible bodies has an effective greater density than the other fluid permeable compressible body.

As described herein, the effective greater density may be provided in a free or non-compressed state, as by greater material density, or by virtue of compression of a fluid permeable compressible body so that the mass per unit volume in the installed state is greater.

In one aspect, the devices include a fluid supply containing a fluid, the fluid supply has a fluid reservoir and a pair of fluid permeable compressible bodies located in the fluid reservoir. One of the fluid permeable compressible bodies has an effective greater density than the other fluid permeable compressible body.

In another aspect, the devices include a fluid supply containing a fluid. The fluid supply has a fluid reservoir defining an upper reservoir portion and a lower reservoir portion that is contiguous with the upper reservoir portion. An upper fluid permeable compressible body is located in the upper reservoir portion and a lower fluid permeable compressible body is located in the lower reservoir portion. The lower fluid permeable compressible body has an effective greater density than the upper fluid permeable compressible body. A dispensing pool area is below and segregated from the lower fluid permeable compressible body for pooling of fluid. A fluid ejector is in flow communication with the dispensing pool area for receiving fluid from the dispensing fluid for ejection of fluid from the device.

It has been discovered that having the two fluid permeable compressible bodies, with one having an effective greater density, advantageously results provides a motive force that results in more complete voiding of the fluid and less residual fluid in the reservoir.

In addition, structures according to the disclosure reduce the volume of the device having void spaces, which further reduces fluid waste as compared to conventional structures.

In yet a further aspect of the disclosure, there is provided a method of providing a fluidic delivery device having a fluid supply containing a fluid within a fluid reservoir.

The method includes the steps of: providing a pair of fluid permeable compressible bodies and locating the pair of fluid permeable compressible bodies within the fluid reservoir of the fluidic delivery device such that the compressible bodies. One of the compressible bodies has an effective greater density than the other fluid permeable compressible body and the compressible bodies retain the fluid at a back pressure achieved by capillary forces between the compressible bodies and the fluid. The compressible bodies cooperate to provides a capillary or motive force that promotes voiding of the fluid from fluid reservoir during use of the fluidic delivery device.

BRIEF DESCRIPTION OF THE DRAWINGS

Further advantages of the disclosure are apparent by reference to the detailed description in conjunction with the figures, wherein elements are not to scale so as to more clearly show the details, wherein like reference numbers indicate like elements throughout the several views, and wherein.

DETAILED DESCRIPTION

The disclosure relates to fluidic devices that promote improved efficiency of dispensing fluid, reducing the amount of fluid that is wasted and remains in the device once it has completed its service life.

Figure 1:
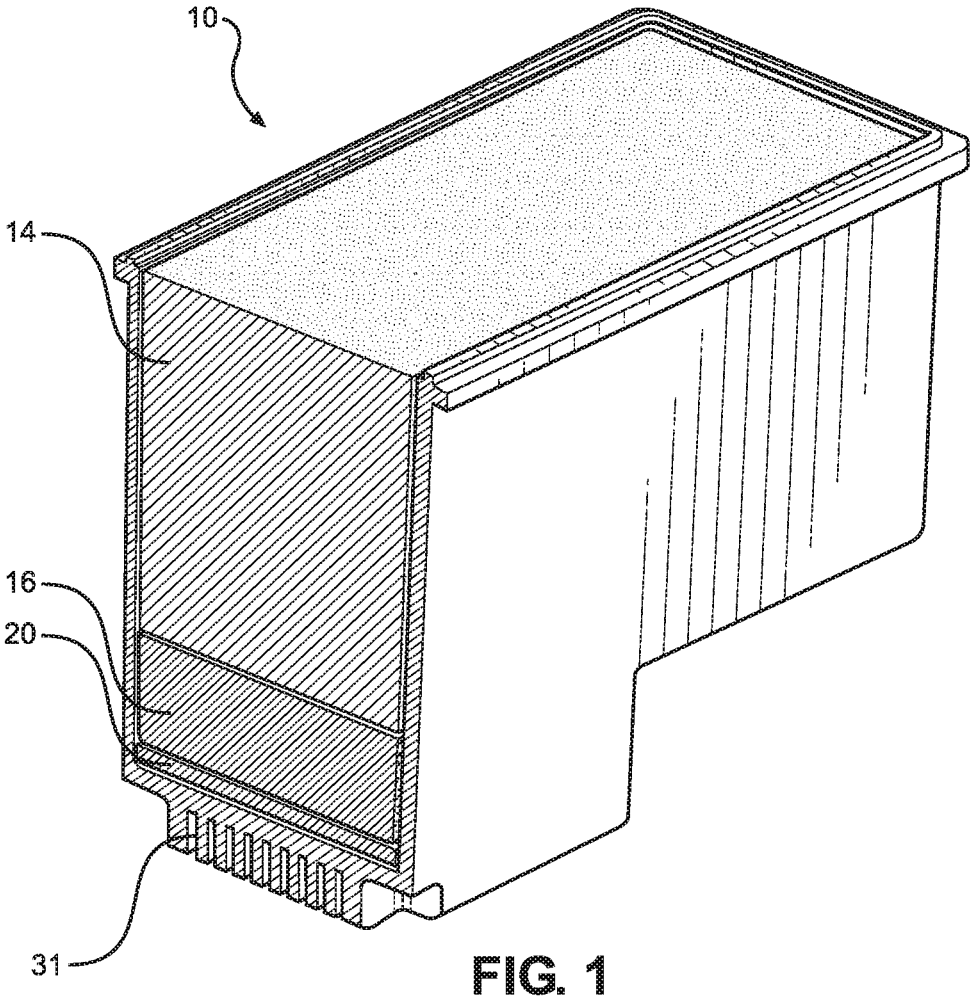
FIG. 1 depicts a fluid container and fluid ejection device according to the disclosure.
Figure 2:
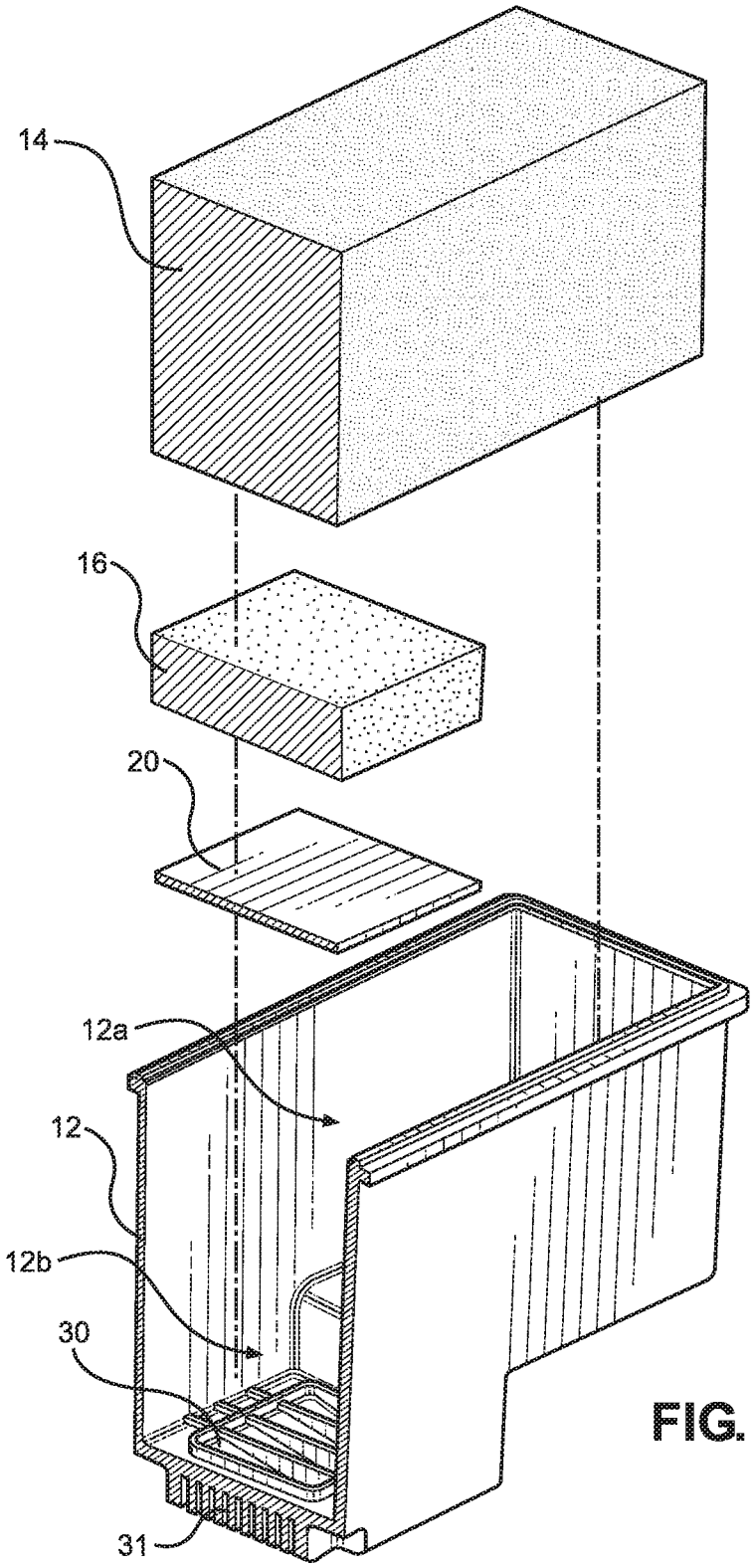
FIG. 2 is an exploded view of FIG. 1.
Figure 3:
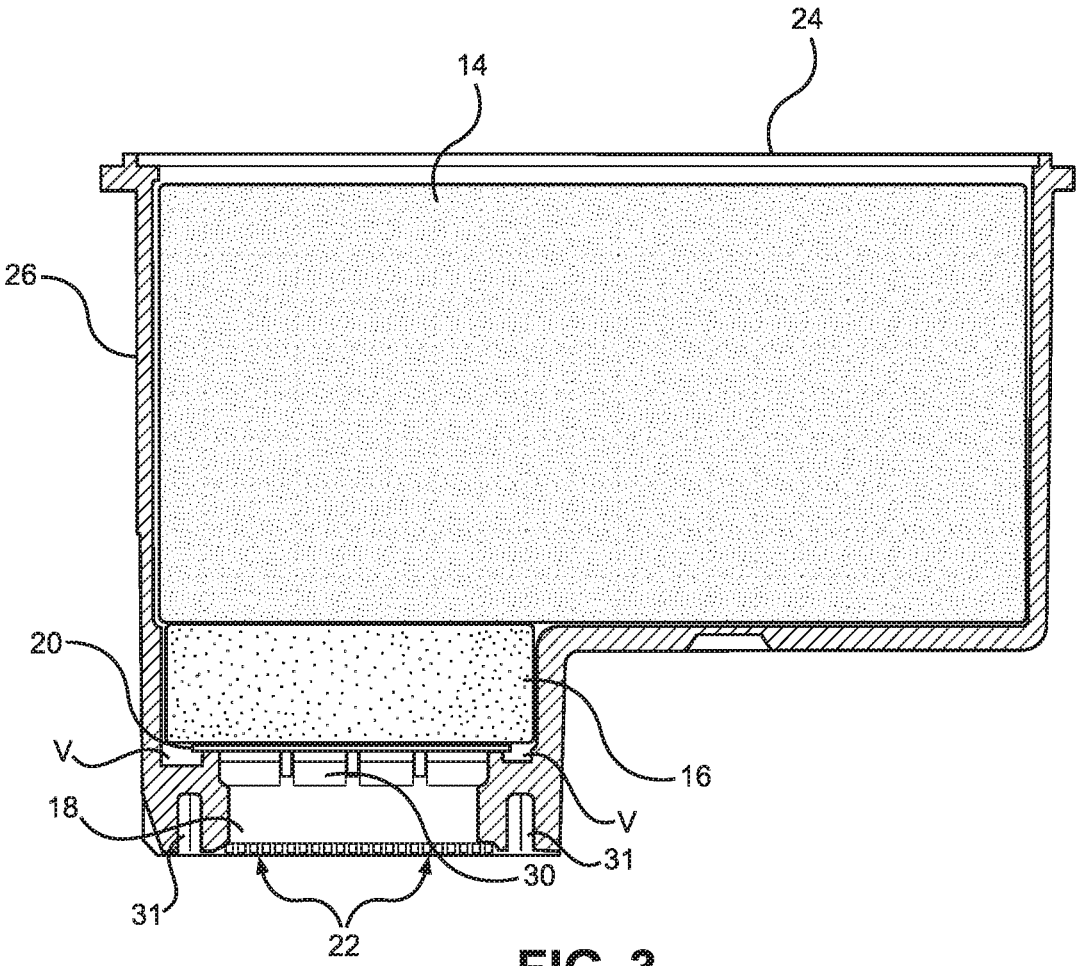
FIG. 3 is a cross-sectional view of a fluid container and fluid ejection device according to the disclosure.

With reference to FIGS. 1-3, there is shown a fluid container and fluid ejection device 10 according to the disclosure. The device 10 is configured as a printhead for delivering ink as the fluid. It will be understood that the device 10 may be configured for delivery of fluids other than ink, and for other purposes.

The device 10 includes a fluid container 12 and a pair of compressible fluid permeable bodies 14 and 16 located within the fluid container 12. A fluid dispensing pool 18 is segregated from, but in fluid communication with, the fluid container 12 and the fluid permeable bodies 14 and 16. A fluid filter 20 is disposed in the fluid container 12 adjacent to the dispensing pool 18. Thus, it will be appreciated that the pool 18 is provided by the space under the filter 20.

A fluid ejector 22 is located adjacent to and in flow communication with the dispensing pool 18 to selectively eject fluid from the device 10. The fluid may be a vaporizable fluid and the fluid ejector 22 may be, for example, a fluid vaporization heater. Electrical connections and logic circuits are integrated onto the device 10 to control and operate the device, including the vaporizer 16, and to otherwise control the transfer of fluid to and the operation of the fluid ejector 22.

The device 10 is initially substantially filled with a volume of fluid so that the fluid container 12 is filled with the fluid, with the permeable spaces of the fluid permeable bodies 14 and 16 filled with fluid, and the dispensing pool 18 being filled with fluid. A top or other cover 24 is applied to the reservoir 12 (FIG. 3) and sealed. The device 10 is shown in FIGS. 1 and 2 with a front wall 26 removed.

It will be understood that the fluid must be maintained in fluid container 12 at a negative pressure. The back pressure must be controlled to be sufficient to prevent the fluid from drooling or escaping from device 10 via the fluid ejector 22. However, the back pressure must also be low enough such that air is not drawn into the device 10 via the ejector 22. The permeable bodies 14 and 16 serve to receive and retain the fluid at an appropriate back pressure achieved by capillary forces between the permeable bodies 14 and 16 and the fluid. Accordingly, once assembled, the device 10 is primed to apply a slight negative pressure to the interior of the device 10, which negative or back pressure is maintained by interaction between the permeable bodies 14 and 16 and the fluid.

During use of the device 10, fluid is ejected and the volume of fluid in the device 10 reduces. When the device 10 has been operated to the extent that the fluid container 12 is depleted of fluid, an air space develops between the filter 20 and the level of the fluid within the dispensing pool 18. Because of this, the permeable bodies are no longer able to function to provide the required back pressure for desired operation of the device 10.

At this point, the device 10 has essentially reached the end of its service life and cannot eject fluid in a reliable manner. Thus, all of the fluid that remains in the dispensing pool 18 at the end of the service life of the device 10 represents fluid that cannot be ejected. While there are other sources of residual fluid, such as on surfaces of the foam and other surfaces within the device, the majority of the remaining fluid is represented by the fluid in the dispensing pool 18. The ratio of the volume of fluid supplied to the device 10 and the fluid ejected represents the volumetric efficiency. Thus, the volume of fluid left in the dispensing pool 18 represents most of the volumetric inefficiency of the device 10.

The fluid container 12 and the fluid permeable bodies 14 and 16 are configured to cooperate to minimize the amount of fluid in the device 10 that is not dispensed during the useful service life of the device. In broad overview, this is accomplished by configuring the device 10 to reduce the volume of the dispensing pool and to utilize foam configured for each geometry of the fluid container 12, both in dimension and in properties.

The fluid container 12 may be provided as by a plastic housing defining a reservoir portion 12*a* and a smaller nose portion 12*b* below the reservoir portion 12*a*. The fluid container 12 thus has a step configuration with the reservoir portion 12*a* and the nose portion 12*b* representing portions of the fluid container 12 of different geometry and dimension.

A tower 30 physically separates the fluid in the reservoir portion 12*a* from the dispensing pool 18 in the nose portion 12*b*. The filter 20 sits atop the tower 30 below the permeable compressible body 16. A grate 31 having open void areas and a rib-like structure is located on the external portion of the fluid container 12 encompassing the ejector 22. The thickness of the grate 31 and the volume of the dispensing pool 18 are selected to minimize the amount of fluid maintained there yet still enable operation of the device. Void areas are represented by reference character V in FIG. 3.

Conventionally, the upper surface of the tower 30 is located at the bottom of the reservoir portion 12*a*, and the smaller nose portion 12*b* is occupied by the tower 30. Thus, only the reservoir portion 12*a* is occupied by a fluid permeable compressible body, and the device utilizes only a single fluid permeable compressible body. As will be appreciated, this construction provides substantially more or larger void areas V not occupied by a fluid permeable compressible body.

Figure 4:
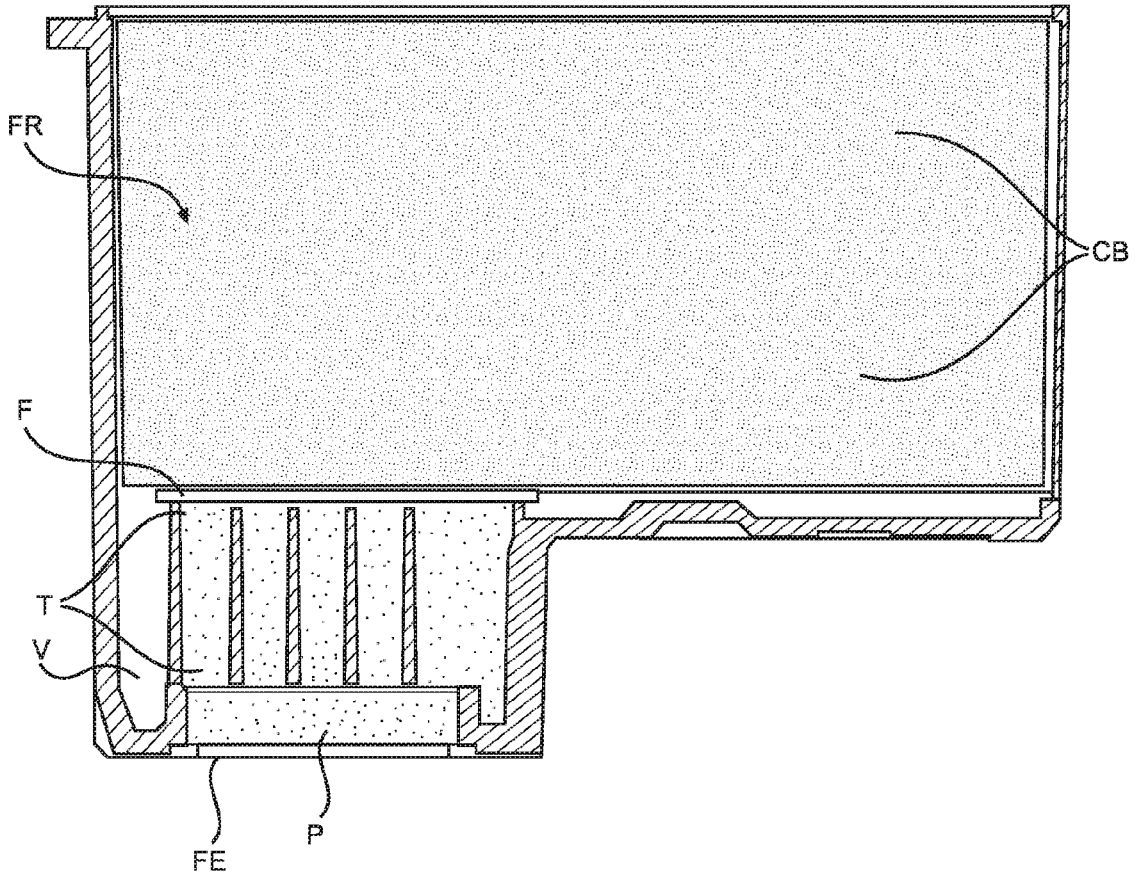
FIG. 4 PRIOR ART
FIG. 4 is a cross-sectional view of a prior art fluid container and fluid ejection device over which devices according to the disclosure have improved volumetric efficiency.

This prior art structure is represented in FIG. 4 for comparison, which also utilizes reference character V to represent void areas for ease of comparison. For example, the prior art structure of FIG. 4 has a fluid reservoir FR having only a single geometry, and the fluid reservoir FR is substantially filled with a single fluid permeable compressible body CB. A tower T is formed below the fluid reservoir FR and occupies the space that corresponds to the nose portion 12*b* in devices according to the disclosure, such that a space corresponding to the nose portion 12*b* is not present. A filter F sits on the tower T. A dispensing pool P is below the filter F, with a fluid ejector FE below the dispensing pool P. A will be appreciated, this prior art structure results in much larger void areas V not occupied by a fluid permeable compressible body as compared to the structure of the disclosure. It has been observed that such structures have decreased volumetric efficiency as compared to structures according to the disclosure.

Returning to FIGS. 1-3, the fluid permeable compressible body 14 is configured to substantially fill the reservoir portion 12*a*. The fluid permeable compressible body 16 is configured to substantially fill the nose portion 12*b*. The density of the fluid permeable compressible body 16 is greater than that of the fluid permeable compressible body 14, or alternatively the same density but with higher compression and/or pores/inch to effectively provide a greater density. Accordingly, the effective greater density may be provided in a free or non-compressed state, as by greater material density, or by virtue of compression of the fluid permeable compressible body 16 so that the mass per unit volume in the installed state is greater.

It has been discovered that having the two fluid permeable compressible bodies 14 and 16 in the stacked configuration, with the lower of the bodies 16 having an effective greater density, advantageously results in a pulling effect of the fluid towards the filter 20. This provides a motive or capillary forces that result in more complete voiding of the fluid and less residual fluid in the fluid container 12.

In addition, structures according to the disclosure including the grate 31 reduce the volume of the device having void spaces and locate an additional fluid permeable compressible body 16 in the nose portion 12*b*. This provides a further reduction in residual fluid. Thus, it has been observed that structures according to the disclosure result in improved efficiency, with reduced fluid waste as compared to conventional structures.

The foregoing description of preferred embodiments for this disclosure has been presented for purposes of illustration and description. The description and embodiments are not intended to be exhaustive or to limit the disclosure to the precise forms disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A fluidic delivery device, comprising:

a one-piece fluid container providing a fluid supply containing a fluid, the fluid supply having a fluid reservoir defining an upper reservoir portion and a lower reservoir portion that is contiguous with the upper reservoir portion;

an upper fluid permeable compressible body located in the upper reservoir portion and a lower fluid permeable compressible body located in the lower reservoir portion, the lower fluid permeable compressible body having an effective greater density than the upper fluid permeable compressible body;

a dispensing pool area located at a lower portion of the one-piece fluid container and having a volume below and segregated from the lower fluid permeable compressible body for pooling of fluid; and a fluid ejector located within a bottom of the one-piece fluid container in flow communication for receiving fluid from the dispensing fluid for ejection of fluid from the device.

2. The device of claim 1, further comprising a grate having a thickness, and wherein unusable area of the fluid container corresponding to volumetric inefficiency is reduced by reducing the thickness of the grate and the volume of the dispensing pool to minimize the amount of fluid maintained there yet still enable operation of the device.

3. The device of claim 1, wherein the lower fluid permeable compressible body has a greater material density than the upper fluid permeable compressible body.

4. The device of claim 1, wherein the lower fluid permeable compressible body has an effective greater density than the upper fluid permeable compressible body by virtue of compression.

5. The device of claim 1, wherein the upper fluid permeable compressible body is a foam body and the lower fluid compressible body is a foam body.

6. The device of claim 1, wherein the lower reservoir portion is smaller in volume than the upper reservoir portion.

7. A method of providing a fluidic delivery device having a one-piece fluid container providing a fluid supply containing a fluid within a fluid reservoir in flow communication with a fluid ejector located within a bottom of the one-piece fluid container, the method comprising the steps of: providing a pair of fluid permeable compressible bodies, comprising an upper fluid permeable compressible body and a lower fluid permeable compressible body, locating the pair of fluid permeable compressible bodies within the fluid reservoir of the fluidic delivery device in a stacked configuration with the upper fluid permeable compressible body overlying the lower fluid permeable compressible body, wherein lower fluid compressible body has an effective greater density than the upper fluid permeable compressible body and the compressible bodies retain the fluid at a back pressure achieved by capillary forces between the compressible bodies and the fluid, wherein the compressible bodies cooperate to provides a motive force that promotes voiding of the fluid from fluid reservoir via the fluid ejector during use of the fluidic delivery device.

8. The method of claim 7, wherein the lower fluid permeable compressible body has an effective greater density than the upper fluid permeable compressible body by virtue of compression during location within the fluid reservoir.

* * * * *